United States Patent [19]

Thievessen et al.

[11] 4,359,195

[45] Nov. 16, 1982

[54] UNWINDING APPARATUS FOR ROLLS OF MATERIAL

[75] Inventors: Karl Thievessen, Grevenbroich; Peter Weiss, Neuss; Herbert Schonmeier, Dusseldorf, all of Fed. Rep. of Germany

[73] Assignee: Jagenberg Werke AG, Dusseldorf, Fed. Rep. of Germany

[21] Appl. No.: 190,530

[22] Filed: Sep. 24, 1980

[30] Foreign Application Priority Data

Sep. 24, 1979 [DE] Fed. Rep. of Germany ..... 2938578

[51] Int. Cl.[3] ..... B65H 17/02

[52] U.S. Cl. ..... 242/68

[58] Field of Search ..... 242/68, 68.4, 67.1 R, 242/58, 58.6, 57, 64, 68.7, 56.2, 56.3

[56] References Cited

U.S. PATENT DOCUMENTS

| | | | |
|---|---|---|---|
| 3,391,876 | 7/1968 | Dalglish | 242/67.1 R |
| 3,635,415 | 1/1972 | Phelps | 242/64 |
| 4,046,331 | 9/1977 | Decker | 242/68 |
| 4,222,512 | 9/1980 | Bugnone | 242/64 |

*Primary Examiner*—Edward J. McCarthy

*Attorney, Agent, or Firm*—Sprung, Horn, Kramer & Woods

[57] ABSTRACT

An unwinding apparatus for rolls of materials pivotably mounts the rolls with a pivot drive at each end of the roll. The torque of each pivot drive is equalized relative to the machine frame in each direction of rotation by providing for each pivot drive, a resiliently mounted lever which is fixed to the pivot drive and a contact member which is linked to the lever. Four switches are arranged in pairs symmetrically with respect to the contact member and are actuated thereby in response to movement of the lever resulting from torquing by the pivot drives.

7 Claims, 3 Drawing Figures

UNWINDING APPARATUS FOR ROLLS OF MATERIAL

BACKGROUND OF THE INVENTION

The invention relates to an unwinding apparatus for rolls of material, such as paper and paperboard rolls, which comprises a pivotable wound roll and, at each end of the roll, a pivot drive.

Unwinding apparatuses of this type are usually driven through one or more self-locking gear units, for example, worm gearing. When the drive comprises two such gear units, their inputs must be ganged or other provision must be made to secure synchronous operation of the two drives, which is complicated and expensive. Driving the gear units with two shunt-wound motors, such as induction motors, operating independently of each other entails the problem that as a result of the different characteristics of the drive motors differences in their speed of rotation will arise. While with such a drive system a rotative-speed equalization occurs through power distribution when a load is raised, lowering of the load will give rise to an increasing rotative-speed difference. The result will be uneven distribution of the torque and jamming of the gear units.

SUMMARY OF THE INVENTION

The object of the invention is to provide an unwinding apparatus of the type outlined above which makes possible by simple means an equalization of the torque, and hence an even distribution of the load on the two drives.

In accordance with the invention, this object is accomplished in that the torque of each pivot drive relative to the machine frame in each direction of rotation is taken up by a resilient lever which is linked to a contact member, and that there are provided in each case four switches which are arranged in pairs symmetrically with respect to the contact member and are adapted to be operated by the latter.

When the two drive motors are unequally loaded, the two levers execute an angular displacement relative to each other, which causes the two diagonally opposed switches of the first pair of switches to be operated simultaneously so as to cut out the leading drive motor until the two levers have resumed the position in which they are not angularly displaced relative to each other. The second pairs of switches serve as protective switches and prevent the excursion of the two levers, which is due to their being resiliently mounted, from exceeding predetermined tolerance limits. Through the cooperation of the first and second pairs of switches, jamming of the drives and excessive twisting of the rotary shaft, and hence canting as the roll is being pivoted, are positively prevented.

The contact member is advantageously linked to the lever through an entrainment means and arranged to slide on a slide rail to which the first pair of switches is fixed. The slide rail in turn is supported in braked guides relative to the machine frame, and the contact member has small tripping tolerance springs relative to the first pair of switches. With higher loading and correspondingly greater displacement of the levers, the slide rail with the first pair of switches is able to move on against the spring force of the resilient mounting on the machine frame because of the braked guides without a switch being damaged while at the same time assurance is provided that the unoperated switch of the first pair upon a pivoting-directional reversal is able to respond immediately, within the tolerance limits set, to an excessive displacement of the levers relative to each other, and hence to unequal loading of the drive motors.

Moreover, the contact member advantageously comprises two curved tripping members, preferably constructed as skids, for operation of the second pair of switches. These curved tripping members are offset relative to each other and to the rest position of the lever in such a way that one of the switches of the second pair, which are fixed to the machine frame, is tripped whenever the limit of the permissible difference path between the levers is reached and cuts out the respective pivot drive. The curved tripping members may be adjustable relative to the contact member, which will permit the tolerance range for the tripping of the second pair to be varied.

In an advantageous embodiment of the invention, the contact member is constructed as a switch blade between the first pair of switches and with curved tripping members for the second pair of switches on the side facing away from the lever.

BRIEF DESCRIPTION OF THE DRAWINGS

An embodiment of the invention will now be described in greater detail with reference to the accompanying drawings, wherein.

DETAILED DESCRIPTION OF THE INVENTION

Figure 1:
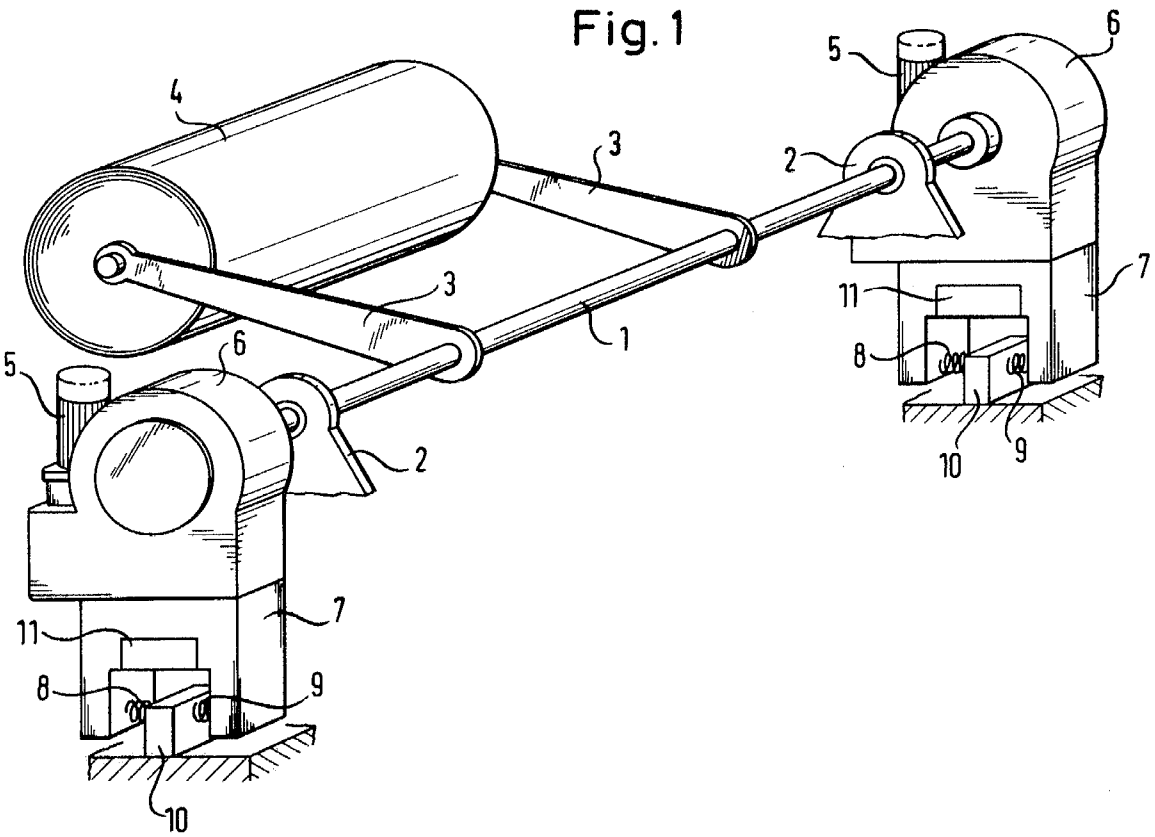
FIG. 1 is a perspective view of an embodiment of the unwinding apparatus in accordance with the invention.

In the unwinding apparatus shown in the drawings, a rotary shaft 1 is rotatably mounted in two supports 2 of the machine frame. Fixed to the rotary shaft 1 are two pivot arms 3 between which a roll 4 is disposed which is to be pivoted, that is to say, raised and lowered. The web of material can be unwound from below or above the web and although the web is pivoted to the left in FIG. 2 it could also operate in a similar manner when pivoted to the right. The rotary shaft 1 is driven by two drive motors 5, which are advantageously induction motors, through two self-locking gear units 6, which are preferably self-locking dual worm-gear units. The gear units 6 are supported on the machine frame 10 through levers 7 and compression springs 8 and 9. A means 11 for equalization of the torque of the two drive motors 5 and the gear units 6 is provided in the lower portion of the levers 7.

Figure 2:
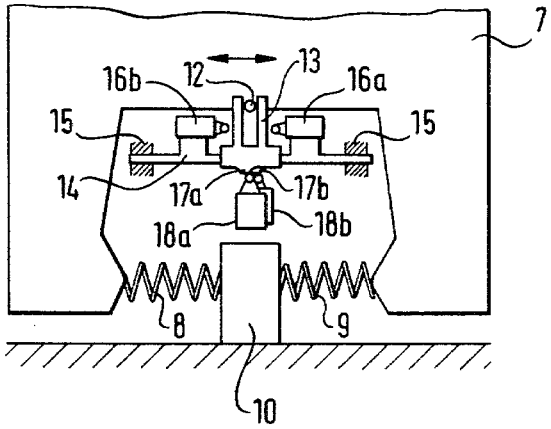
FIG. 2 is an enlarged view of the section comprising the contact member and switches of the unwinding apparatus.

As shown in FIG. 2, the means 11 for equalization of the torque comprises a contact member 13 in the form of a switch blade which is linked to the lever 7 through an entrainment means 12. The contact member 13 is slidingly disposed on a slide rail 14 which is supported in braked guides 15. The resistance to the sliding motion of the contact member 13 on the slide rail 14 is less than the guiding resistance of the slide rail 14 in the braked guides 15.

Figure 3:
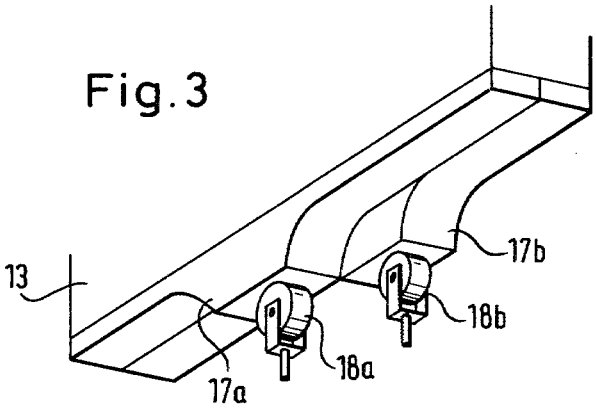
FIG. 3 is a perspective view of the side of the contact member facing away from the lever.

Disposed on either side of the contact member 13 in close proximity thereto, and adapted to be operated thereby, are switches **16*a* and 16*b*, which are fixed to the slide rail 14. The contact member 13 is provided on its underside with two curved tripping members 17***a* and 17*b*, as is apparent from FIG. 3. Said curved tripping members 17*a* and 17*b* serve to operate a further pair of switches 18*a* and 18*b* which are fixed to the machine frame. To permit adjustment of the tripping points of the switches 18*a* and 18*b*, said curved tripping members 17*a* and 17*b* may be adapted to be positioned or displaced relative to the contact member 13.

When a roll 4 is mounted on the left side of the unwinding apparatus, the lever 7 is displaced rightwardly against the force of the compression spring 8. So long as there is no relative rotation between the two levers 7 at the two ends of the roll 4, both contact members 13 are entrained rightwardly by the two entrainment means 12 and then press against both switches 16*a*. The operation of the two switches 16*a* has no electrical effect on the pivot drive. The excursion of the two compression springs 8 is greater than the contact travel of the switches 16*a*, and the switches 16*a* along with the slide rails 14 are therefore forced to the right in the braked guides 15 until the compression springs 8 allow no further travel. Through this provision for displacement, the destruction of the switches 16*a*, which are designed as limit switches, is prevented.

Since the switches 16*a* and 16*b* of the first pair of switches are disposed on a common slide rail 14 and are fixed thereto, switch 16*b*, not contacted so far, has also traveled toward the right in the operation described. As a result, it has retained its initial slight spacing from the contact member 13. Now when a relative motion occurs between the two levers 7 due to a twisting of the rotary shaft 1 as a result of unequal loading of the drive motors 5, one of the switches 16*a* is released and on the same side, even after a slight angular displacement, the corresponding switch 16*b* is contacted and pressed, the corresponding drive motor 5 then being influenced by the pressing of the diagonally opposed switches 16*a* and 16*b* in such a way that the torque developed by each of the two drive motors 5 is again equalized and the twisting of the rotary shaft 1 is overcome. Thus an angular displacement of the levers 7 relative to each other is quickly and positively detected, regardless of the common position of the levers 7, since the switches 16*a* and 16*b* of the first pair of switches are at all times in proximity to the contact member 13, which is constructed as a switch blade.

The switches 18*a* and 18*b* of the second pair of switches serve to monitor the total angular displacement of the levers 7 and to cut out the pivot drive when the preset tolerance limits are exceeded. To permit the tolerance limits to be adjusted, the curved tripping members 17*a* and 17*b* may be displaced relative to the contact member 13, if necessary. The switches 18*a* and 18*b* of the second pair of switches are provided to prevent overloading of the two drive motors 5 and destruction of the gear units 6 in the event of a failure of the switches 16*a* and 16*b* of the first pair of switches. The switches 18*a* and 18*b* thus function as overload limit switches. Overall, providing the switches 16*a* and 16*b* and the switches 18*a* and 18*b* in conjunction with the contact member 13 makes possible highly responsive control and monitoring of the torque of each of the drive motors 6, and hence the prevention of damage to the entire drive system.

It will be appreciated that the instant specification and claims are set forth by way of illustration and not of limitation, and that various changes and modifications may be made without departing from the spirit and scope of the present invention.

What is claimed is:

1. In an unwinding apparatus for rolls of material of the type wherein the rolls are mounted with a pivot drive at each end of the roll with respect to a machine frame, the improvement comprising means for equalizing the torque of each pivot drive relative to the machine frame in each direction of rotation comprising for each pivot drive, a lever connected thereto, means resiliently mounting the lever to the machine frame, a contact member linked to the lever and four switches arranged in pairs symmetrically with respect to the contact member and actuated thereby in response to movement of the lever resulting from torquing by the pivot drives.

2. An unwinding apparatus according to claim 1, wherein the equalizing means further comprises for each pivot drive, a slide rail on which one pair of switches are mounted and entrainment means disposed on the slide rail for sliding movement thereon and linking the contact member to the lever.

3. An unwinding apparatus according to claim 2, wherein the equalizing means for each pivot drive further comprises braked guides fixed relative to the machine frame for supporting the slide rail and wherein the contact member has small tripping tolerance springs from the one pair of switches.

4. An unwinding apparatus according to claim 3, wherein the contact member comprises two curved tripping members for actuating the other pair of switches.

5. An unwinding apparatus according to claim 4, wherein the curved tripping members are configured as skids.

6. An unwinding apparatus according to claim 4 or claim 5, wherein the curved tripping are displaceable relative to the contact member.

7. An unwinding apparatus according to claim 4, wherein the contact member comprises a switch blade disposed between the one pair of switches and having the curved tripping members for the other pair of switches on the side facing away from the lever.

* * * * *